US006296094B1

(12) United States Patent
Knecht

(10) Patent No.: US 6,296,094 B1
(45) Date of Patent: Oct. 2, 2001

(54) COMBINATION COSMETIC BAG AND TRAVEL BAG WITH MULTIPLE CARRYING MODES

(76) Inventor: Wendy S. Knecht, 630 San Vincente Blvd., Unit "S", Santa Monica, CA (US) 90402

( * ) Notice: Subject to any disclaimer, the term of this patent is extended or adjusted under 35 U.S.C. 154(b) by 0 days.

(21) Appl. No.: 09/520,046

(22) Filed: Mar. 7, 2000

Related U.S. Application Data

(60) Provisional application No. 60/123,991, filed on Mar. 11, 1999.

(51) Int. Cl.[7] ..... A45C 7/00; A45C 13/30

(52) U.S. Cl. ..... 190/107; 190/109; 190/901; 383/4; 206/281

(58) Field of Search ..... 190/109, 107, 190/901; 150/100; 206/581; 303/4, 38, 39

(56) References Cited

U.S. PATENT DOCUMENTS

| | | | | |
|---|---|---|---|---|
| Re. 34,474 | | 12/1993 | Lutz | 224/32 A |
| 2,205,205 | * | 6/1940 | King | 190/901 X |
| 2,265,680 | * | 12/1941 | Ward | 190/901 X |
| 3,041,638 | * | 7/1962 | Lo Vico | 190/901 X |
| 4,244,453 | | 1/1981 | Herz | 190/43 |
| 4,420,068 | | 12/1983 | Gerch | 190/102 |
| 4,436,189 | | 3/1984 | Baum | 190/108 |
| 4,515,493 | * | 5/1985 | Radovich | 190/901 X |
| 4,655,343 | | 4/1987 | Lane et al. | 206/287 |
| 4,825,985 | | 5/1989 | Kim | 190/111 |
| 4,901,897 | | 2/1990 | Briggs et al. | 224/153 |
| 4,953,674 | | 9/1990 | Landes | 190/108 |
| 5,002,401 | * | 3/1991 | Blackman | 190/107 X |
| 5,117,974 | | 6/1992 | Beiber | 206/278 |
| 5,358,106 | | 10/1994 | King et al. | 206/278 |
| 5,377,794 | * | 1/1995 | Book | 190/107 X |
| 5,398,807 | | 3/1995 | Plath | 206/298 |
| 5,413,198 | * | 5/1995 | Ferris | 190/107 X |
| 5,425,449 | * | 6/1995 | Boorady | 190/107 X |
| 5,458,239 | | 10/1995 | Plath | 206/298 |
| 5,469,967 | | 11/1995 | Boorady | 206/527 |
| 5,535,880 | | 7/1996 | Plath | 206/298 |
| 5,564,539 | | 10/1996 | Duensing | 190/107 |
| 5,566,797 | * | 10/1996 | Van Himbeeck | 190/107 X |
| 5,676,223 | * | 10/1997 | Cunningham | 190/109 |
| 5,692,604 | | 12/1997 | Houk | 206/278 |
| 5,732,817 | | 3/1998 | Plath | 206/298 |
| 5,865,233 | * | 2/1999 | Roegner | 150/106 X |
| 5,918,711 | * | 7/1999 | Godshaw | 190/107 |
| 6,109,402 | * | 8/2000 | Godshaw et al. | 190/107 |

FOREIGN PATENT DOCUMENTS

| | | | | |
|---|---|---|---|---|
| 2270898 | * | 3/1994 | (GB) | 190/901 |

* cited by examiner

*Primary Examiner*—Sue A. Weaver
(74) *Attorney, Agent, or Firm*—Fish & Richardson P.C.

(57) ABSTRACT

A travel bag is disclosed that includes a pair of flaps. The flaps fold with respect to each other to lay flat or can be positioned to lie adjacent with respect to each other as would be used in a travel bag. Each flap also has at least one sub-flap that enables similar orientation with respect to its respective flap. This combination enables the bag to be positioned flat as it would be if hung open, folded in half as a travel/garment bag or folded to one-quarter size as a travel carryon item or even smaller with additional sub-flaps. The bag can also include a series of pockets, at least some of which are in the form of modules, each may contain several receptacles or individual pockets.

26 Claims, 4 Drawing Sheets

COMBINATION COSMETIC BAG AND TRAVEL BAG WITH MULTIPLE CARRYING MODES

CROSS REFERENCE TO RELATED APPLICATION

This application claims priority from U.S. provisional application Ser. No. 60/123,991, filed Mar. 11, 1999, abandoned.

BACKGROUND OF THE INVENTION

The invention herein relates to luggage and more particularly to a travel bag especially adapted for airline travel.

It is generally known that airlines and other transportation carriers restrict the amount of luggage that passengers can carry on board with them. Passengers therefore often reluctantly check luggage into the baggage compartment. Due to the high volume of checked luggage, some is lost. Consequently, the traveling public is often greatly inconvenienced by the loss or delay in receiving their personal items. Stricter regulations concerning carryon baggage has also forced travelers to limit the amount of items that they bring with them.

Another problem encountered by travelers that is related to luggage is pre-travel packing, "living out of the luggage" while away and repacking for the return trip. This process also leaves room for error in the fast paced world of the packing and traveling. These errors usually result in forgetting to bring items, and inadvertently leaving items in hotel rooms and the like.

Basic needs of the traveler in this area have thus far avoided the marketplace. A need exists for travel bags that conform to air carriers guidelines for size while allowing maximal packing efficiency and ease of locating and repacking travel items.

SUMMARY OF THE INVENTION

Present Invention:

In one aspect, the invention features a luggage or travel bag that includes a first flap and a second flat joined together by a flap connector disposed therebetween. At least one first sub-flap and at least one second sub-flap is positioned as part of the first flap and the second flap respectively, and located opposite to the flap connector. The device also includes a plurality of pockets attached to the first flap and the second flap. This combination of the flaps allows for multiple foldable configurations of the travel bag with storage of items in the pockets.

The system may also include a first flap and a second flat joined together by a flap connector disposed therebetween with the first flap including a fastener. In addition, two closure flaps are secured to each of the two sides of the second flap, adjacent to the flap connector. The closure flaps extend laterally from the respective sides of the second flap and include a fastener secured to the distal end thereof. This allows the closure flaps, when, folded around the sides of the second flap, to be secured by the fasteners on the closure flaps. This creates an enveloping feature about the area between said first flap and said second flap to more completely secure items in the bag.

In another aspect, the invention includes a method of varying luggage dimension utilizing the afore mentioned system of flaps and sub-flaps. By positioning the first sub-flap and the second sub-flap to be substantially coplanar with the first flap and the second flap respectively and then repositioning the first sub-flap and the second sub-flap to be substantially parallel but not coplanar with the first flap and the second flap respectively, the overall dimension of the bag will be altered. This ability enables the user to reduce the overall dimension of the luggage bag as needed or desired. The aforementioned ability to provide modular receptacles that are releasably secured to at least one of said flaps, also aids in the ability of groups of articles to be removed and added to the luggage device with the addition or removal of a single receptacle.

Definition of Terms:

Unless otherwise defined, all technical and scientific terms used herein have the same intended meaning as would be commonly understood by anyone of ordinary skill in the art to which this invention belongs. To eliminate possible ambiguity, specific terms used herein have been defined as they would be applied to the present invention.

DETAILED DESCRIPTION OF THE PREFERRED EMBODIMENTS

The object of the disclosed invention is to provide an improved method of packing, and in the use of luggage for traveling. The invention is especially useful in regard to carryon luggage for commercial transportation. The size of a piece of carryon luggage is strictly enforced by air carriers regarding the overall size of the device. Items over a specified size must the checked to the baggage claim resulting in delays for the traveler and in some cases lost luggage. The invention also discloses a modular packing system that can aid the traveler in reduced packing time and also reducing the likelihood of lost or forgotten travel items.

Figure 1:
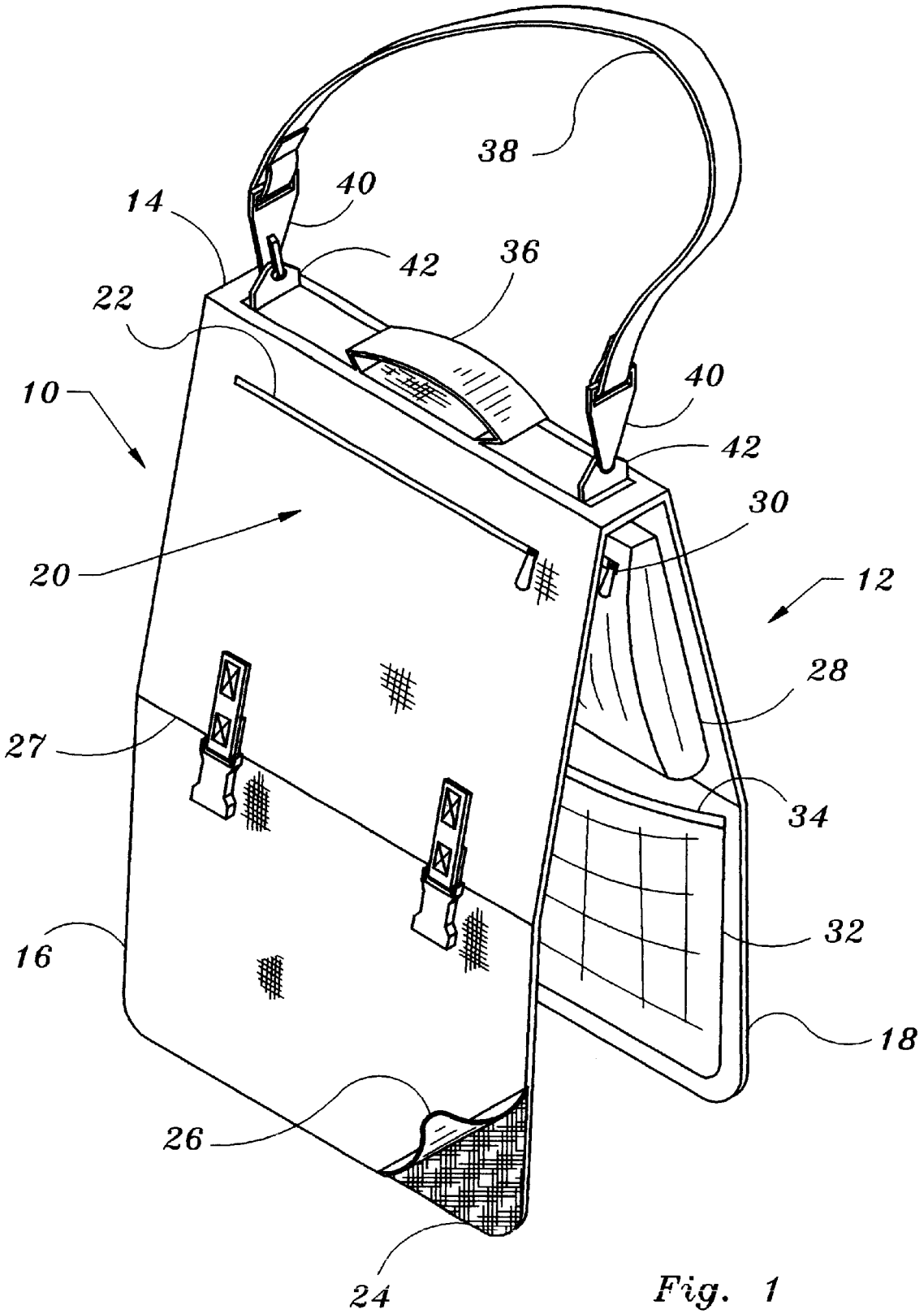
FIG. 1 is an isometric view of a travel bag, without closure flaps and positioned in a single fold carry mode, the device produced in accordance with an alternative preferred embodiment of the present invention.

Referring to the drawings, FIG. 1 shows a simplified version of a travel bag in a single-fold position. In its single-fold position, the length of the bag is one-half its full, unfolded length. The bag includes a first flap 10 and a second flap 12 joined together by a flap connector 14. The first flap 10 includes a first sub-flap 16 and likewise the second flap 12 includes a second sub-flap 18. A plurality of pockets are included in the bag including an outside pocket 20 accessible by a zipper 22. The outside pocket can be positioned in any or all of the flaps, including the sub-flaps and can be secured by any type of fastener commonly used in the art. Other fasteners include snaps and hook and loop type fasteners.

The flaps can be constructed of any of a number of materials. In an embodiment, a semi-rigid material 24 is used under a fabric cover material 26. The semi-rigid material gives the invention a basic form, aiding in the appearance and function in offering protection to items stored within the first 10 and second 12 flaps. In this embodiment, a fold line 27 is created to separate the first sub-flap 16 from the rest of the first flap 10. The fold line 27 does not include the semi-rigid material 24 so that the sub-flap 16 can change its orientation with respect to the rest of the flap 10. In another embodiment the semi-rigid material 24 is only used in the flap connector 14, leaving the first flap and the second flap 12 pliable to conform to the needed conditions.

The specifics of the semi-rigid material is not intended to be limiting to the scope of the invention, but suggested materials include cardboard, plastic metal and wood. In a similar manner the flap connector 14 is also desirable to be constructed of a material set similar to the flaps.

The first 10 and second 12 flaps include pockets on the inside as positioned in this figure. It is intended that the majority of all products that would be stored in the bag would be placed in these pockets. A removable pocket 28 is shown as being secured to the inside of the second flap 12. This pocket would likely also include a type of fastener to secure items therein, here being shown as a zipper 30. As previously disclosed, any type of fastener or other functional equivalent could be used in place of that shown. Below the removable pocket 28 is a mesh pocket 32 shown on the inside of the second sub-flap 18. This pocket opening may be restricted from opening, preferably by an elastic strap 34 situated at the opening of the pocket 32.

With the bag in the single-fold position shown in FIG. 1, the length of the flaps can be made great enough to carry a suit or other articles of clothing, such as pants that are lengthy with only a single fold. This is desirable because multiple folds can cause wrinkles that are difficult to remove by the traveler, especially adding the inconveniences of being away from home. If necessary the length of the bag can be reduced in size by folding the sub-flaps under the flaps. In this double-fold configuration (see FIG. 3), the length of the bag is one-quarter its full, unfolded length. Since this additional fold is so easily accomplished, this can be done temporarily to satisfy baggage officials and then unfolded shortly thereafter. This minimal time in a folded position minimizes the wrinkling effect on any long garments stored therein.

To carry the bag in this form two handles are included. The hand handle 36 is preferably secured to the center of the flap connector 14. This allows single hand carrying of the bag in its long or open form. Also included is a long strap or shoulder strap 38 that is releasably secured by clips 40 to the rings 42 at the outer edges of the flap connector 14. This allows the user to carry the bag "hands free" by placing the strap 38 over the shoulder of the user.

Figure 2:
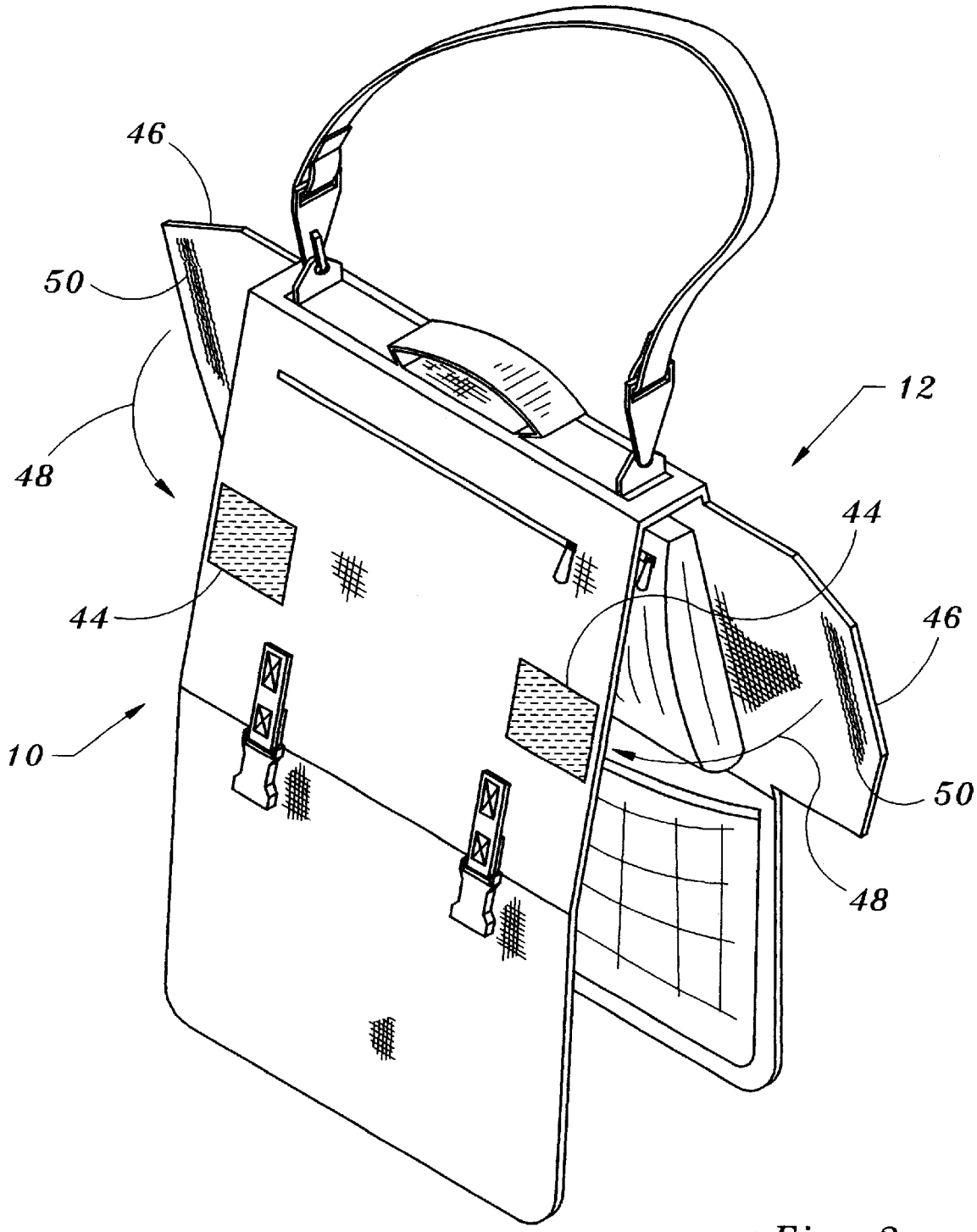
FIG. 2 is an isometric view of a travel bag, with closure flaps and positioned in a single fold carry mode, the device produced in accordance with the preferred embodiment of the present invention.

The bag is further shown in FIG. 2. Here the first flap 10 includes a pair of fasteners 44 attached thereto. These fasteners 44 secure the closure flaps 46, attached to the second flap 12, to the first flap 10 to close the sides of the bag, thereby further securing the articles carried therein. This is accomplished by moving the closure flaps 46 in the direction of the arrows 48 to releasably secure the mating fasteners 50 to the fasteners 44 on each side of the bag. This type of fastener shown here is a hook and loop type fastener, and is considered to be the preferred embodiment due to the flexibility in placement of the adjoining parts.

Another fastener type would be a mechanical snap, the male position on the closure flaps 46 and the female portion on the first flap 10. The positioning can be reversed and in either case the snaps do provide a secure means of fastening that does not wear after repeated usage. The limitation being the necessity of critical location of one part with respect to the other part. This can be a problem in a luggage device since a dissimilar amount and overall size of items can be packed. A possible solution would be multiple snaps on one component, preferably the first flap 10. This would allow the snap on the appropriate closure flap 46 to vary in its position on the first flap according to the fullness of the invention.

Figure 3:
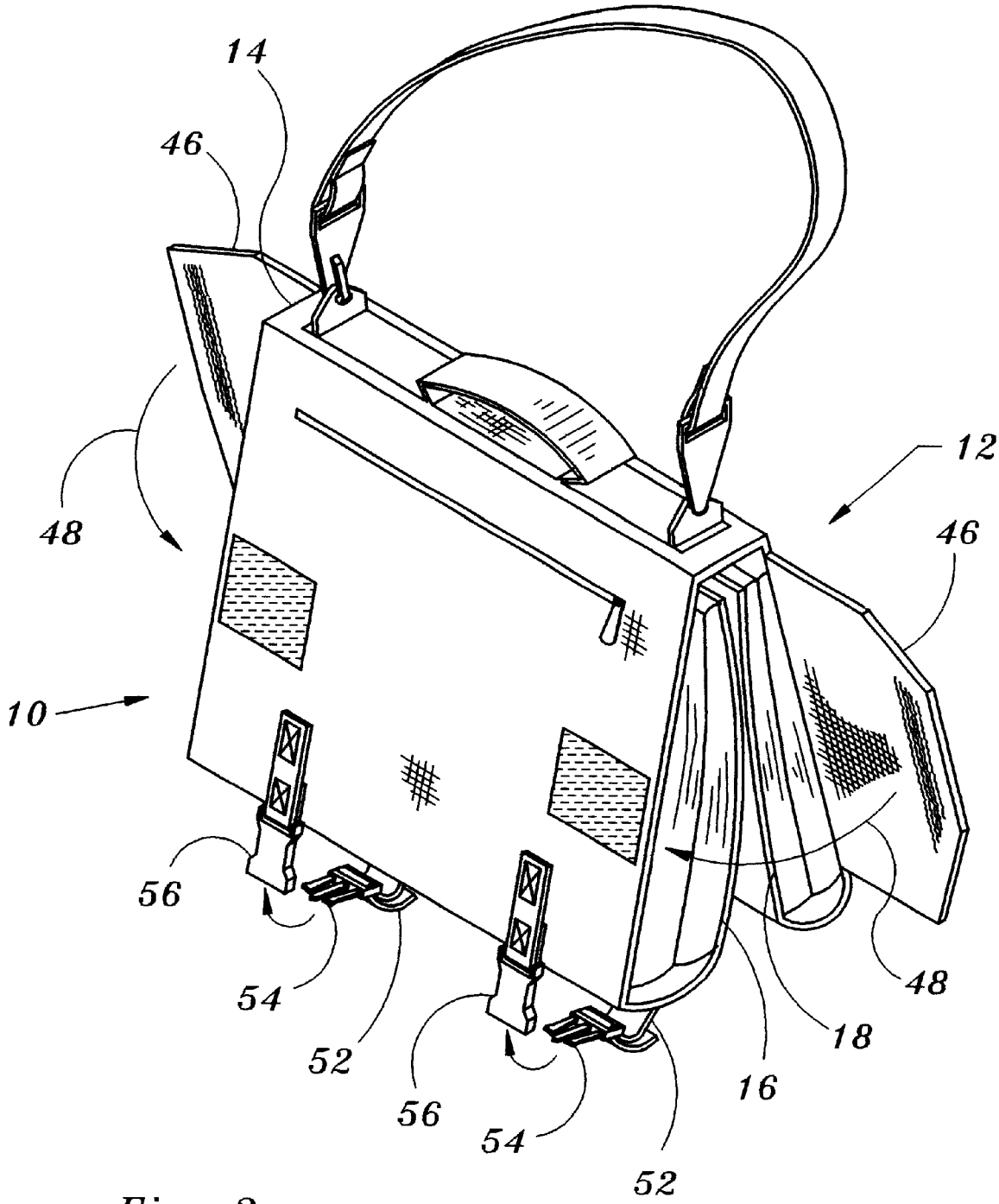
FIG. 3 is an isometric view of a travel bag, with closure flaps and positioned in a double fold carry mode, the device produced in accordance with the preferred embodiment of the present invention.

The double fold orientation of this version of the bag is shown in FIG. 3. The first sub-flap 16 and the second sub-flap 18 are folded inward, underneath the upper portion of the first flap 10 and the second flap 12 respectively. The closure flaps 46 can then be rotated about the side of the bag, enveloping the articles located therein, as shown by the arrows 48. The fasteners 44 and mating fasteners 50 secure the closure flaps into position. Though only a double fold is shown, any number of folds can be made with this bag. As such, multiple sub-flaps can be created as part of the first flap 10 and the second flap 12. The folding process would follow as is shown here for each sub-flap in that they could fold or remain unfolded, as is deemed desirable by the user.

Another security feature that can be used is shown on all versions of the bag, but primarily used only when the bag is in this double fold position. This feature includes the use of one or more bottom straps 52 that are secured to the back side of the second flap 12. The straps 52 are then secured to the first flap 10 by use of male buckle 54 and the female buckle 56. Coupling these buckles then positions the straps 52 under the first 10 and second 12 flaps, closing the bottom of the bag and securing the first 16 and second 18 sub-flaps in a captured position between the upper portions of the first flap 10 and second flap 12. The result is a reduced size travel bag that can be made to conform to the rigid restrictions for carryon luggage. In addition, the foldability to a reduction in size makes the device more desirable to the user in that one bag is dynamically able to conform to multiple sizes to efficiently perform a variety of functions. This means the consumer only has to buy one bag where otherwise more bags would need to be purchased.

Another method of securing the bottom of the bag is by means of a zipper with one of each side of the zipper attached to each of the first sub-flap 16 and the second sub-flap 18. By zipping the structure together the bag is then closed on the bottom, further securing the items therein. In addition to a zipper, mechanical snaps, or any other fastening means commonly know in the art could also be used as a functional equivalent. Also, the means of securing the straps 52 and the number of straps 52 are not intended to be limiting to the scope of the invention. A variety of fastening methods such as hook and loop and other mechanical snap devices known in the art are acceptable for this function.

Figure 4:
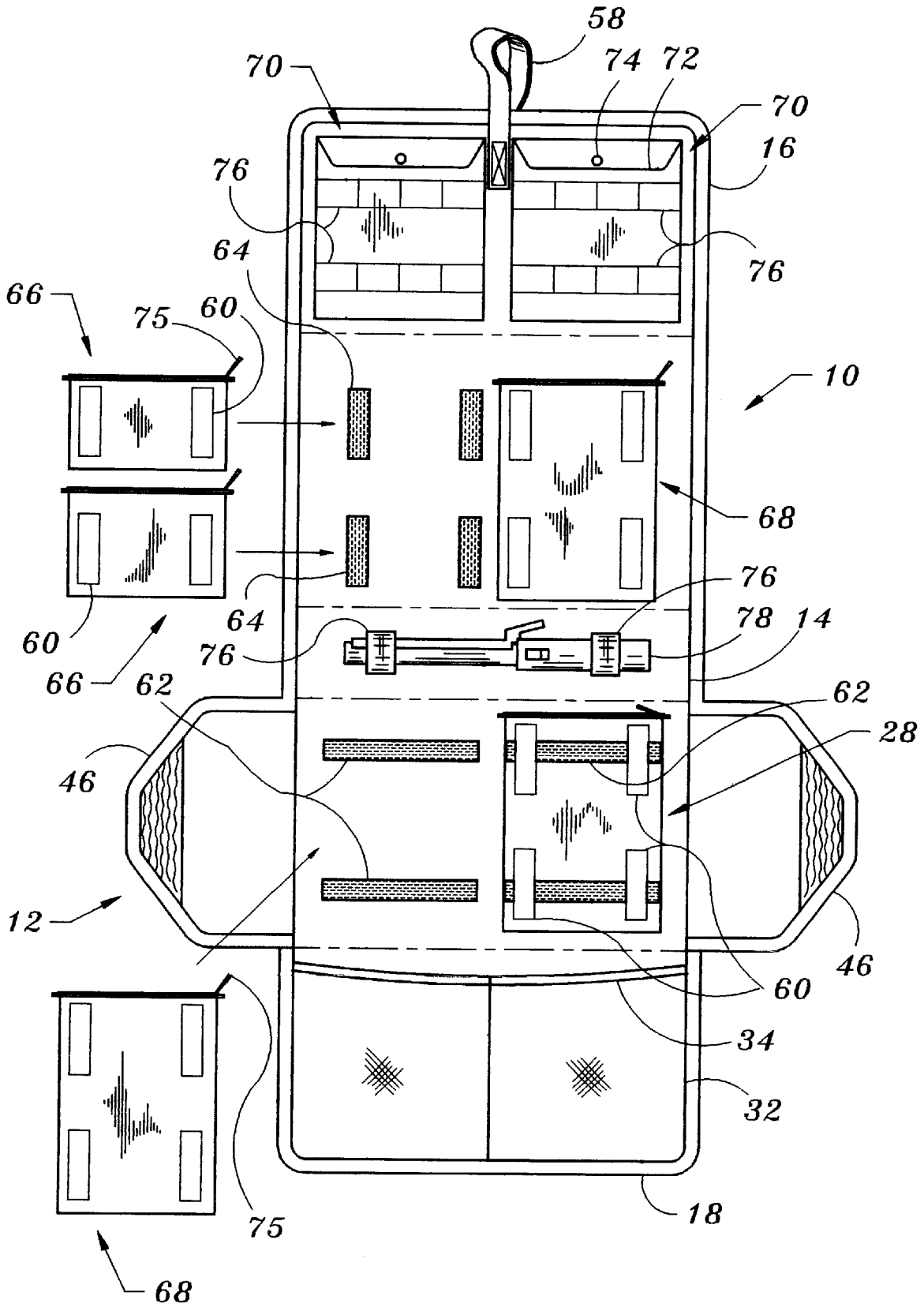
FIG. 4 is a plan view of a travel bag, with closure flaps and positioned in an unfolded or hanging the device would by the hook strap, the device produced in accordance with the preferred embodiment of the present invention.

The bag is shown in FIG. 4 in a unfolded or hanging position. What is shown here is the entire inside of the bag as it would appear hanging open, with all compartments and pockets accessible to the user. The first flap 10, the flap connector 14 and the second flap 12 are in a top to bottom orientation with the closure flaps 46 laid out for display purposes. To assist in positioning the bag in this way an anchor strap 58 is connected to the first sub-flap 16. The anchor strap 58 is preferably comprised of a substantially longitudinal strap material that is releasably secured to the first sub-flap 16 such that at least one end of the strap 58 can be unfastened from the sub-flap 16, secured about a towel rack or other anchoring structure and then refastened to the sub-flap 16. This allows the bag to be displayed as shown, with fall access to the pockets contained therein.

A variety of storage pockets are disclosed in their use with the bag itself. The removable pocket 28, as referenced earlier, is shown here in more detail. The removable pocket is shown to be preferably manufactured out of a clear material, so that items can be easily seen therein. This is not a necessity of the invention, in that opaque materials would also function in the primary purpose, which is to store items. Utilizing the concept of clear material, the details of the items in the pockets can be more easily identified. The removable pocket includes a method of fastening to the bag. This is shown here as four strips 60, each comprising one side of a hook and loop fastener. The long mating strips 62 are attached to the bag at various locations on the inside of the second flap 12 and short vertical mating strips 64 on the inside of the first flap 10. This orientation is not specific to the invention but is done to demonstrate the diverse nature of these modes of attachment. As is shown here, a variety of sizes of pockets can be randomly arranged as deemed desirable by the user. Here a pair of small pockets 66 with their strips 60 attached thereto can be used in conjunction with or in place of large pockets 68.

The mesh pockets 32 are situated on the inside of the second sub-flap 18. These are likely used for loose items. The items are secured therein by the elastic strap 34, as previously noted.

Permanent pockets 70 are also provided in this version of the bag. An opening that includes a flap 72 that is secured by a mechanical snap 74 is shown here. This method of opening and securing the pockets are interchangeable with the use of a zipper 75 in the large pockets 68 and the small pockets 66. Other forms such as hook and loop fasteners are also acceptable in this application.

The permanent pockets 70 are shown here to include a set of hoop straps 76. These hoop straps 76 are comprised of a substantially longitudinal strap with each end secured to an adjacent position to the first flap 10. The hoop strap 76 is preferably manufactured of an elastic material so that the resulting loop or hoop between the fastened ends, can receive items of varying sizes and shapes, securing them in the pocket 70, flap 10 or other supporting structure. These hoop straps 76 can also be attached to the second flap 12 (not shown) or to the flap connector 14. On the flap connector 14 a pair of hoop straps 76 are shown adjacently positioned in a vertical orientation to support an item. Here a typical item such as a curling iron 78 is shown.

The specific orientation and display of the elements of the disclosed invention are considered to be the preferred embodiments, but are not intended to be limiting to the scope of the invention. It is understood that an infinite combination of variations in the use and placement of these pockets and straps is inherently included in this disclosure.

What is claimed is:

1. A travel bag comprising:

a first flap and a second flap permanently joined together by a flap connector disposed therebetween;

a first sub-flap and a second sub-flap positioned as part of said first flap and said second flap respectively, and located opposite to said flap connector, said first flap being foldable along a boundary of said first sub-flap, and said second flap being foldable along a boundary of said second sub-flap, allowing for multiple foldable configurations of said travel bag, wherein the multiple foldable configurations include a single-fold configuration and a double-fold configuration, said single-fold configuration reducing a length of said bag to one-half of an unfolded length, and said double fold configuration reducing a length of said bag to one-quarter of said unfolded length; and a plurality of pockets attached to said first and second flaps.

2. The travel bag as described in claim 1, wherein said flap connector is constructed of a semi-rigid material that is covered with fabric.

3. The travel bag as described in claim 2, wherein said semi-rigid material is a material selected from the group consisting of cardboard, plastic, metal and wood.

4. The travel bag as described in claim 1, wherein a portion of said first flap and said second flap include a semi-rigid structure that is covered with fabric.

5. The travel bag as described in claim 4, wherein said semi-rigid material is a material selected from the group consisting of cardboard, plastic, metal and wood.

6. The travel bag as described in claim 1, wherein said plurality of pockets include pockets accessible through a pocket opening in said first or said second flap.

7. The travel bag as described in claim 1, wherein said plurality of pockets include pockets that are comprised of sets of pockets in the form of modules.

8. The travel bag as described in claim 7, wherein said modules are comprised of cavities of various shapes and sizes.

9. The travel bag as described in claim 7, wherein said modules are releasably secured to said first flap or said second flap.

10. The travel bag as described in claim 9, wherein said modules are releasably secured by use of fasteners selected from the group consisting of hook and loop, and mechanical snaps.

11. The travel bag as described in claim 7, wherein said modules are manufactured of a plastic material.

12. The travel bag as described in claim 1, further comprising a handle fastened to said flap connector.

13. The travel bag as described in claim 12, wherein said handle is a substantially longitudinal length of material comprising a shoulder strap.

14. The travel bag as described in claim 1, further comprising at least one substantially longitudinal strap, with each end secured in an adjacent position to said first flap, said second flap or said flap connector, thus comprising a hoop strap.

15. The travel bag as described in claim 14, wherein said hoop strap is manufactured of an elastic material.

16. The travel bag as described in claim 1, further comprising a substantially longitudinal anchor strap having a first end secured to an inside of said first flap and a second end secured to an outside of said first flap.

17. The travel bag as described in claim 1, wherein said boundaries of said first and second sub-flaps comprise fold lines.

18. The travel bag as described in claim 17, wherein said first and second fold lines are disposed approximately at midpoints of said first and second flaps, respectively.

19. A travel bag comprising:

a first flap and a second flap permanently joined together by a flap connector disposed therebetween;

a first sub-flap and a second sub-flap positioned as part of said first flap and said second flap respectively, and located opposite to said flap connector, said first flap being foldable along a boundary of said first sub-flap, and said second flap being foldable along a boundary of said second sub-flap, allowing for multiple foldable configurations of said travel bag;

a plurality of pockets attached to said first and second flaps;

a pair of first fasteners disposed on said first flap; and a pair of closure flaps attached to said second flap, each said closure flap having a second fastener disposed thereon, said second fasteners being configured to engage with said first fasteners.

20. The travel bag as described in claim 19, wherein said fasteners are selected from the group consisting of hook and loop, and mechanical snaps.

21. The travel bag as described in claim 19, wherein said first fasteners are disposed on opposite sides of a first surface of said first flap, and said closure flaps are attached to opposite sides of said second flap.

22. The travel bag as described in claim 19, wherein the multiple foldable configurations include a single-fold configuration and a double-fold configuration, said single-fold configuration reducing a length of said bag to one-half an unfolded length, and said double fold configuration reducing the length of said bag to one-quarter the unfolded length, and wherein engagement of said first fasteners with said second fasteners secures said bag in either said single-fold or said double-fold configuration.

23. The travel bag as described in claim 19, wherein said plurality of pockets include sets of pockets in the form of modules, said modules being releasably secured to said first flap or said second flap.

24. A method of varying luggage dimension comprising:

providing a luggage device which includes a first flap and a second flap permanently joined by a flap connector;

providing a first sub-flap and a second sub-flap positioned as part of said first flap and said second flap respectively, and located opposite to said flap connector;

positioning said first sub-flap and said second sub-flap to be substantially coplanar with a remainder of said first flap and a remainder of said second flap respectively; and repositioning said first sub-flap and said second sub-flap to be substantially parallel but not coplanar with said remainders of said first and second flaps respectively, thereby reducing the overall dimension of said luggage device.

25. The method as described in claim 24, including providing a plurality of modular receptacles that are releasably secured to at least one of said flaps, whereby groups of articles can be removed and added to said luggage device with the addition or removal of a single receptacle.

26. The method as described in claim 24, wherein said first fold line is positioned at a midpoint of said first flap, and said second fold line is positioned at a midpoint of said second flap, such that folding said first and second flaps along said first and second fold lines respectively reduces the overall dimension of said luggage device by half.

* * * * *